United States Patent [19]

Aoshima

[11] 4,205,419

[45] Jun. 3, 1980

[54] APPARATUS FOR CUTTING A TYING BAND OF A COILED MATERIAL

[75] Inventor: Kiyoji Aoshima, Komatsu, Japan

[73] Assignee: Kabushiki Kaisha Komatsu Seisakusho, Tokyo, Japan

[21] Appl. No.: 971,407

[22] Filed: Dec. 20, 1978

[30] Foreign Application Priority Data

Dec. 20, 1977 [JP] Japan ..... 52-152455

[51] Int. Cl.[2] ..... B23P 19/04

[52] U.S. Cl. ..... 29/56.5; 83/156; 83/563; 83/600; 83/909; 83/923; 83/924

[58] Field of Search ..... 29/56.5, 564.3; 83/156, 83/909, 924, 923, 600, 563

[56] References Cited

U.S. PATENT DOCUMENTS 3,377,687 4/1968 De Chellis ..... 29/56.5

*Primary Examiner*—J. M. Meister

*Attorney, Agent, or Firm*—Armstrong, Nikaido, Marmelstein & Kubovcik

[57] ABSTRACT

An apparatus for cutting a tying band of a coiled material comprising a cutter for cutting the tying band, and pinch rollers for pinching and transferring the tying band after it is cut out. The cut comprises a lower cutter and a pair of upper cutters pivotally mounted on the lower cutter. The lower cutter is connected to a hydraulic cylinder and adapted to be moved up and down along a guide which is obliquely mounted to a base member by the actuation of the hydraulic cylinder. The tying band is being cut out between the lower cutter and the upper cutters.

5 Claims, 7 Drawing Figures

APPARATUS FOR CUTTING A TYING BAND OF A COILED MATERIAL

BACKGROUND OF THE INVENTION

This invention relates to an apparatus for cutting a tying band of a coiled material provided in blanking lines or shearing lines. Coiled materials of this kind are generally banded and therefore prevented from uncoiling.

When feeding the coiled materials into blanking lines or shearing lines, tying bands for the coiled materials have been cut out manually by an operator while they are placed on uncoilers and thereafter the cut-out tying bands are drawn out by rotating the coiled materials.

Therefore, there has been a potential danger for the operator to be injured due to the spring back action of the cut-out tying bands and/or the coiled materials. Accordingly, the conventional manual cutting process is troublesome and time consuming in disposing the tying bands.

SUMMARY OF THE INVENTION

It is therefore an object of the present invention to provide an apparatus for automatically cutting a tying band of a coiled material.

Another object of the present invention is to provide an apparatus for cutting a tying band of a coiled material wherein the operator is completely free from accidental injuries caused by spring back action of the cut-out band and coiled material.

In accordance with an aspect of the present invention, there is provided an apparatus for cutting a tying band of a coiled material comprising a base member; guide means fixedly secured to said base member, said guide means being inclined relative to said base member; first cylinder means fixedly secured to said base member; a lower cutter connected to said first cylinder means at one end thereof, said lower cutter having a cutting edge formed therein at the other end thereof and being adapted to be moved up and down guided by said guide means upon the actuation of said first cylinder means; a pair of upper cutters pivotally mounted on said lower cutter, each of said upper cutters having a cutting edge formed therein at the leading end thereof; second cylinder means mounted astride on said pair of upper cutters; and pinch roller means for pinching and transferring the tying band after it is cut out.

The above and other objects, features and advantages of the present invention will be readily apparent from the following description taken in conjunction with the accompanying drawings.

DETAILED DESCRIPTION OF THE INVENTION

Figure 1:
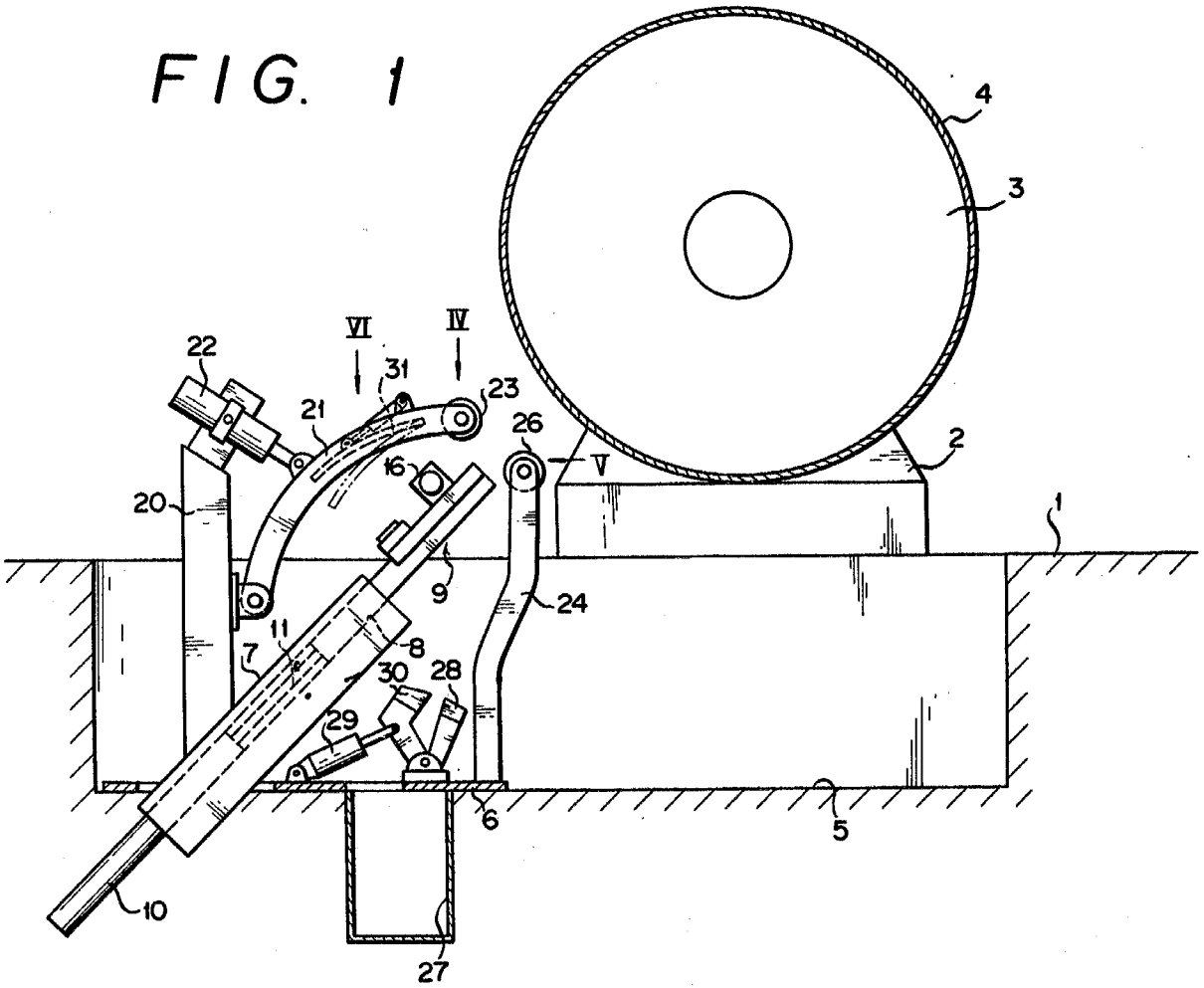
FIG. 1 is a side elevational view of a cutting apparatus according to the present invention.

The present invention will now be described in detail with reference to the accompanying drawings. Reference numeral 1 denotes a floor or ground surface on which an uncoiler 2 is installed. Mounted on the uncoiler 2 is a coiled material 3, which is banded by a tying band 4 the width of which is narrower than that of the coiled material 3. Reference numeral 5 denotes a pit 5 provided underneath the uncoiler 2. Placed on the bottom surface of the pit 5 is a base member 6 to which a guide member 7 is obliquely fixedly secured. The guide member 7 has a guide hole 8 formed therein in which a cutter member 9 is slidably inserted. A cylinder 10 is fixedly secured to the base member 6 and a piston rod 11 is connected to the cutter member 9.

Figure 2:
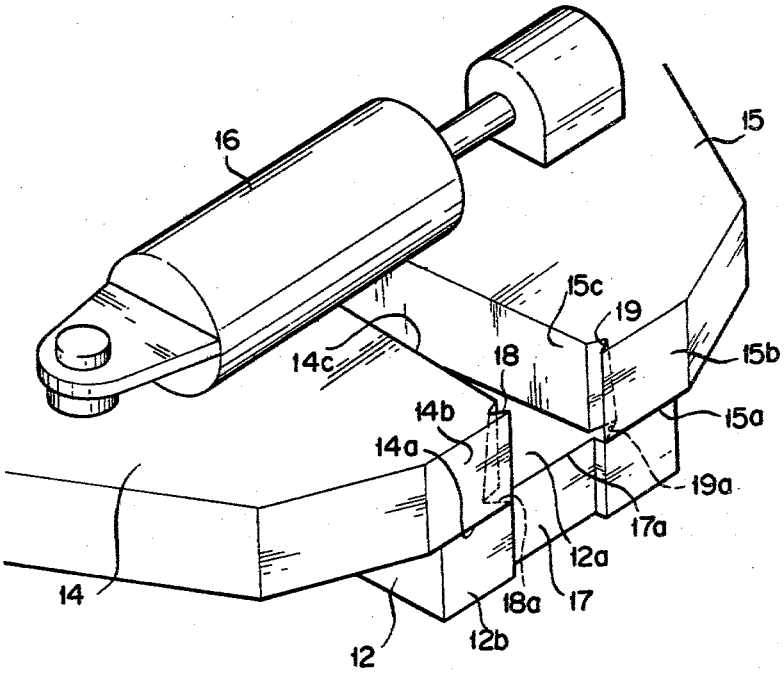
FIG. 2 is an enlarged perspective view of lower and upper cutters.
Figure 3:
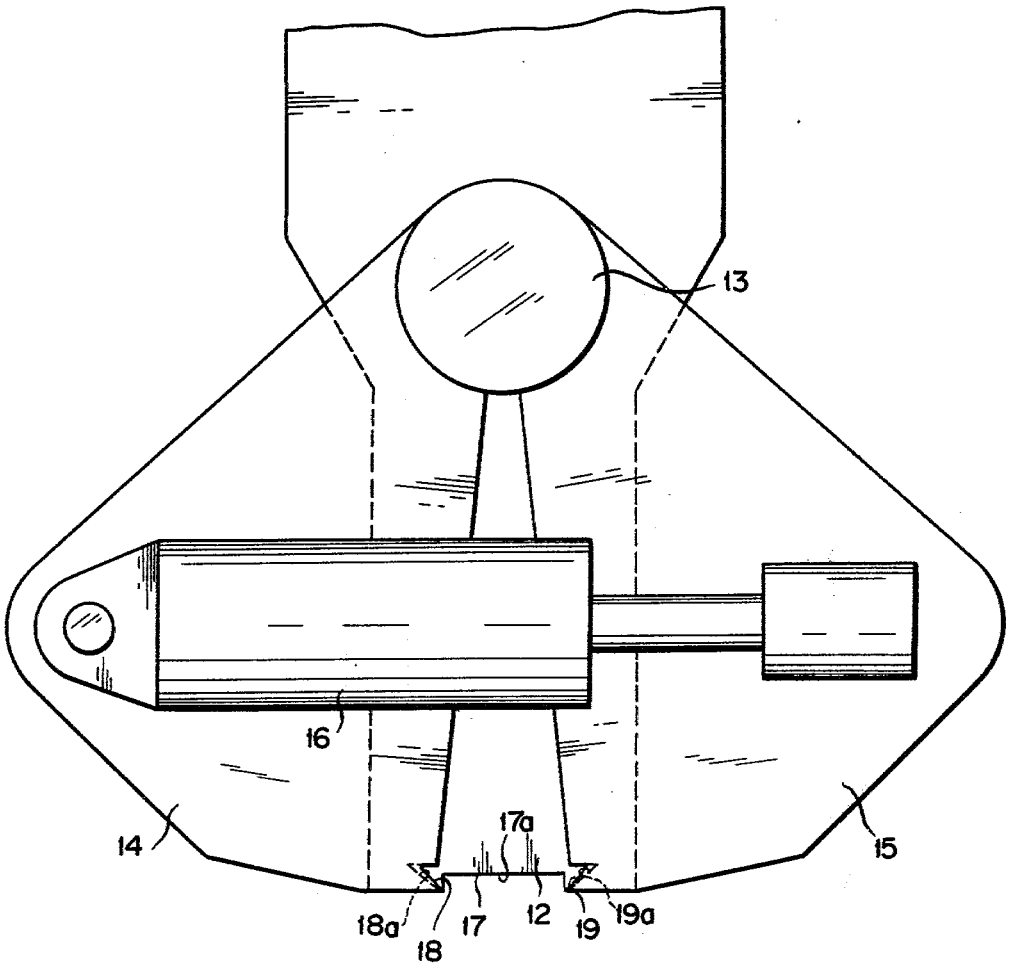
FIG. 3 is a plan view thereof.
Figure 6:
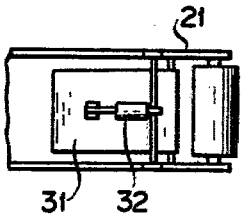
FIG. 6 is a view as seen from an arrow VI in FIG. 1.
Figure 4:
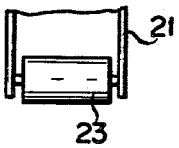
FIG. 4 is a view as seen from an arrow IV in FIG. 1 showing one of pinch rollers.

As clearly illustrated in FIGS. 2 and 3, the cutter member 9 comprises a lower cutter 12 and a pair of upper cutters 14 and 15 pivotally mounted at pin 13 on the lower cutter 12 so as to be opened and closed each other. A hydraulic cylinder 16 is mounted astride on the upper cutters 14 and 15 for closing and opening the same upon actuation.

The lower cutter 12 has a flat upper surface **12*a* and a front surface 12*b* in which a shallow groove 17 is formed the width of which is wider than that of the tying band 4. The upper cutters 14 and 15 have flat lower surfaces 14*a*, 15*a*, front surfaces 14*b*, 15*b* and opposing side surfaces 14*c*, 15*c* respectively. Formed in the leading ends of the respective opposing surfaces 14*c*, 15*c* are longitudinal grooves 18, 19 having a generally V-shaped cross-section the depth of which becomes shallower continuously towards the upper surfaces 14*a*, 15*a***.

Reference numeral 20 denotes a column mounted upright on the base member 6.

A pair of arms 21 are pivotally mounted in the vertical direction by means of a hydraulic cylinder 22 which is mounted on the top end of the column 20. A pinch roller 23 is rotatably mounted between the leading ends of the pair of arms 21.

Reference numeral 24 denotes a second column mounted upright on the base member 6 and a second pinch roller 26 which is intermittently driven by a motor 25 is rotatably mounted on the leading end of the column 24 opposing the pinch roller 23.

An auxiliary pit 27 is provided in the pit 5. A cutter blade 28 is fixedly secured to and another cutter blade 30 is pivotally mounted on the base member 6 above the pit 27. The pivotal movement of the cutter blade 30 is effected by a hydraulic cylinder 29 mounted on the base member 6.

Reference numeral 31 denotes a guide plate pivotally mounted in the vertical direction on the arms 21, the pivotal movement of which being effected by a hydraulic cylinder 32.

The operation of the present invention will now be described hereinbelow.

First of all, the hydraulic cylinder 10 is operated to move the cutter member 9 towards the coiled material 3 thereby facing the shallow groove 17 to the tying band 4. By further extending the piston rod 11, the surface of the coiled material is pressed in by the front surface **12*b* of the lower cutter 12 leaving the tying band 4 neatly seated within the shallow groove 17**.

Then the hydraulic cylinder 16 is operated to move the pair of upper cutters 14 and 15 towards each other to sandwich the tying band 4 by the longitudinal grooves 18 and 19. By further retracting a piston rod of the cylinder 16, the tying band 14 is cut out between the lowest cutting edges 18*a*, 19*a* of the longitudinal grooves 18, 19 and the upper front edge 17*a* of the shallow groove 17 formed in the lower cutter 12.

After having been cut, one end of the cut-out tying band 4 is squeezed and firmly holed between the longitudinal generally V-shaped grooves 18 and 19.

Figure 7:
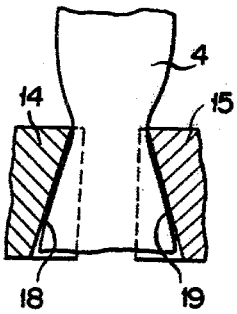
FIG. 7 is a longitudinal cross-sectional view of upper cutters cut at generally V-shaped grooves showing how the tying band is holded between a pair of upper cutters after it is cut out.
Figure 5:
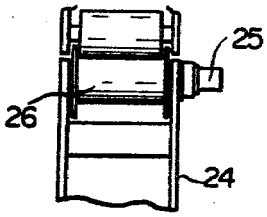
FIG. 5 is a view as seen from an arrow V in FIG. 1 showing the other pinch roller.

The tying band 4 is hardly get out of the grooves 18, 19 since the both grooves 18 and 19 are so designed that the closer to the upper surface, the shallower the depth is (FIG. 7).

Then the piston rod 11 of the hydraulic cylinder 10 is retracted to move the cutter member 9 downwards thereby pulling down the cut-out tying band 4.

The hydraulic cylinder 22 is then actuated to swing down the arms 21 to pinch the tying band 4 between the pinch rollers 23 and 26. After having pinched the tying band 4 between the pinch rollers 23, 26, the cylinder 16 is actuated to move the pair of upper cutters 14 and 15 apart from each other thereby releasing the holding of the tying band between the longitudinal grooves 18 and 19. Then the cylinder 10 is operated again to move the cutter member 9 downwards to a position which is low enough not to interfere with the transferring of the tying band 4 as explained below. The cylinder 32 is then actuated to swivel down the guide plate 31 to a position wherein the tying band 4 can be guided to reach the auxiliary cutting means comprising the cutter blades 28 and 30. The motor 25 is rotated intermittently by actuating a control means not shown to transfer the tying band 4 along the guide plate 31 to the auxiliary cutting means. After the tying band 4 is fed between the blades 28 and 30, the cylinder 29 is actuated to cut the tying band 4 into a pre-selected length. By repeating this second cutting step, the tying band 4 is cut into small pieces and fell into the auxiliary pit 27.

As mentioned hereinabove, according to the present invention the tying band 4 is not only automatically cut out but it is cut into fragments and collected in the auxiliary pit 27.

It is to be understood that the foregoing description is merely illustrative of the preferred embodiment of the present invention and that the scope of the present invention is not to be limited thereto, but is to be determined by the appended claims.

I claim:

1. An apparatus for cutting a tying band of a coiled material comprising a base member;

guide means fixedly secured to said base member, said guide means being inclined relative to said base member;

first cylinder means fixedly secured to said base member; a lower cutter connected to said first cylinder means at one end thereof, said lower cutter having a cutting edge formed therein at the other end thereof and being adapted to be moved up and down guided by said guide means upon the actuation of said first cylinder means;

a pair of upper cutters pivotally mounted on said lower cutter, each of said upper cutters having a cutting edge formed therein at the leading end thereof;

second cylinder means mounted astride on said pair of upper cutters; and pinch roller means for pinching and transferring the tying band after it is cut out.

2. An apparatus as defined in claim 1 wherein said lower cutter has a wide groove formed therein at the leading end thereof and wherein each of said upper cutters has a generally V-shaped longitudinal groove formed in the leading end of the opposing side surface thereof, the generally V-shaped groove being so designed that the closer to the upper surface thereof, the shallower the depth is.

3. An apparatus as defined in claim 1 wherein said pinch roller means comprises a first column fixedly secured to said base member, a pair of arms pivotally mounted on said first column, a first pinch roller rotatably mounted on said arms at the leading ends thereof, a second column fixedly secured to said base member, and a second pinch roller rotatably mounted on said second column at the leading end thereof.

4. An apparatus as defined in claim 3 wherein said pinch roller means further comprises third cylinder means mounted on said first column for causing a pivotal movement of said arms when actuated and second guide means pivotally on said arms.

5. An apparatus as defined in claim 1, 2, 3, or 4 wherein auxiliary cutter means is mounted on said base member, said auxiliary cutter means comprising a first blade fixedly secured to said base member and a second blade pivotally mounted on said base member.

* * * * *